US008113455B2

(12) United States Patent
Pallmann

(10) Patent No.: US 8,113,455 B2
(45) Date of Patent: Feb. 14, 2012

(54) DEVICE FOR GRINDING INPUT MATERIAL

(75) Inventor: Hartmut Pallmann, Zweibruecken (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 82 days.

(21) Appl. No.: 11/798,644

(22) Filed: May 15, 2007

(65) Prior Publication Data

US 2008/0006729 A1 Jan. 10, 2008

(30) Foreign Application Priority Data

May 15, 2006 (DE) ..... 10 2006 022 886

(51) Int. Cl.
*B02C 7/04* (2006.01)

(52) U.S. Cl. ..... 241/261.2; 241/298

(58) Field of Classification Search ..... 241/261.2, 241/261.3, 298, 296
See application file for complete search history.

(56) References Cited

U.S. PATENT DOCUMENTS

| | | | | |
|---|---|---|---|---|
| 6,053,440 | A * | 4/2000 | LaRiviere | 241/46.01 |
| 6,932,290 | B2 * | 8/2005 | Virving | 241/298 |
| 6,957,785 | B2 * | 10/2005 | Virving | 241/166 |
| 7,134,463 | B2 | 11/2006 | Pallmann | |
| 7,694,902 | B2 * | 4/2010 | Demler et al. | 241/21 |
| 2002/0166912 | A1 * | 11/2002 | Schneid | 241/298 |

FOREIGN PATENT DOCUMENTS

| | | |
|---|---|---|
| DE | 202 08 606 | 10/2003 |
| DE | 202 16 056 | 4/2004 |

* cited by examiner

*Primary Examiner* — Faye Francis
(74) *Attorney, Agent, or Firm* — Muncy, Geissler, Olds & Lowe, PLLC

(57) ABSTRACT

A device for grinding input material is provided with a supporting disk rotating around an axis of rotation within a housing. On the supporting disk, in its circumferential area, first grinding tools are arranged concentrically, axially opposite from which second grinding tools are arranged, forming a radial grinding gap. During operation of a device in accordance with the invention, the grinding tools execute a motion relative to one another. In accordance with an embodiment, the first grinding tools be fastened over an interchangeable ring to the supporting disk, wherein the interchangeable ring is fastened removably to the supporting disk concentric to the axis of rotation and on which the first grinding tools are arranged.

20 Claims, 4 Drawing Sheets

23'
27'
34
42
25'
26'
35
41
39'
37'
38'
30'
7

23
33
25
40
39
37
38
30
21

23
27
25
32
26
28
39
37
38
30
21

DEVICE FOR GRINDING INPUT MATERIAL

This nonprovisional application claims priority under 35 U.S.C. §119(a) to German Patent Application No. DE 102006022886, which was filed in Germany on May 15, 2006, and which is herein incorporated by reference.

BACKGROUND OF THE INVENTION

1. Field of the Invention

The present invention relates to a device for grinding input material.

2. Description of the Background Art

Devices of this class are known, for example, from DE 202 16 056, which corresponds to U.S. Pat. No. 7,134,463, or from DE 202 08 606. The disk mills disclosed there are characterized by a grinding chamber, surrounded by a housing, in which grinding tools rotating around a central axis of rotation are arranged. The grinding tools in this case are located at an axial distance, with maintenance of an identical radial distance from the axis of rotation and thus form a rotationally symmetric grinding gap in which the grinding work takes place.

The input material is introduced axially into the central area of the grinding chamber and then deflected in a radial direction, where it is taken up and ground by the profiled surfaces of the rotating grinding tools.

During the operation of a conventional device of this class, grinding tools are exposed to high mechanical stress, which among other things depends on the type and purity of the input material. As a result, natural wearing of the grinding tools takes place, which with increasing tool lifetime increasingly impairs the quality of the final product. Therefore as a result of wear it is necessary to replace the used grinding tools with new ones at regular intervals.

Another reason for the frequent changing of grinding tools is the adaptation of a device of this class to a different material to be ground or a different end product to be achieved. Especially in the case of contract grinding, the input material can vary from one contract to the next, so that adaptation of the grinding tool to the varying input material through the use of suitable grinding tools is necessary.

Naturally, each change in the grinding tools is necessarily linked with considerable shutdown times of the grinding device, resulting in production shutdowns for the operator of the device. The shutdown times thus have an important influence on the operating economy of a device of this class.

SUMMARY OF THE INVENTION

It is therefore an object of the present invention to minimize the shutdown times caused by changing the grinding tools without restricting the functionality of the invention.

It has proven problematic in finding a solution to this task that the extent of the shutdown times required for making changes depends on a number of factors. As examples it is possible to mention the material quality of the grinding tools, the accessibility into the interior of the machine, the manner of fastening of the tools, and the like. This results in the necessity of considering all factors for a suitable solution to achieve acceptable success. It is the achievement of the invention to have discovered a solution that meets these requirements with only minor additional construction expense.

Through the arrangement of the grinding tools on an interchangeable ring, all grinding tools are completely changed upon replacement of the interchangeable ring. This advantage is especially felt when individual segments are used as grinding tools, since a considerable expense for installation and removal is linked with the fastening of the individual segments. Thanks to this invention it is possible, when additional interchangeable rings are kept in reserve, to attach the individual segments to the additional interchangeable ring outside of the grinding device without interrupting the grinding operation. Thus the shutdown time is reduced merely to the time span for the replacement of the interchangeable ring, which can be conducted by loosening or tightening a few screws.

The use of an interchangeable ring in accordance with the invention also permits wear-optimized design of the device. Whereas in the case of known devices the grinding function and the load removal function were combined in the grinding tools, according to the invention an assignment of this function to different machine components is now provided. The load removal function is completely taken on by the interchangeable ring, which therefore can be of a softer, less high quality steel and therefore has high resistance to dynamic stress. The grinding tools on the other hand no longer have a supporting function within a device in accordance with the invention. Therefore they can be made of an extremely hard and thus wear-resistant material. Such a combination is characterized by longer tool lives and simultaneously lower manufacturing costs. In this process the full functionality of the device in accordance with the invention is maintained, since not only annular grinding tools with simple radial corrugation can be used, but also segmented grinding tools, the corrugation of which can vary for adaptation to the type of material input and the properties of the final product.

In a simple embodiment of the invention, an interchangeable ring in accordance with the invention is provided at least in the case of the rotating grinding tools, since the mechanical stress and therefore the wear is higher there. Preferably, however, both of the grinding tools that form the grinding gap are respectively mounted on the interchangeable ring. In this case the invention comprises both embodiments in which both interchangeable rings are fastened to rotating supporting disks, and those in which an interchangeable ring is supported in a fixed location on the device.

In an embodiment of the invention, the interchangeable ring is subdivided in a radial direction into an outer circumferential area, which forms the accommodation for the grinding tools, and an inner circumferential area for fastening them to the supporting disk. Therefore the assembly of the grinding tools outside of the grinding device from the rear side of the interchangeable ring is also possible, so that the effective grinding surface will not be reduced or impaired by screw heads or the like. Through a corresponding design of the grinding disks, if desired the screw heads on the rear side of the interchangeable ring are covered by the supporting disk and are thus protected from material accumulations and mechanical stresses which would otherwise make loosening of the fastening screws more difficult.

The accommodation of the grinding tools on the interchangeable ring takes place according to an embodiment of the invention through the shape of the indentations corresponding to the grinding tools, so that force-locking is accomplished by means of form-locking. The fastening screws in this process serve essentially for fixing the grinding tools in the indentation.

The inner circumferential area that serves for fastening the interchangeable ring to the supporting disk permits the interchangeable ring to be screwed in from the front side of the interchangeable ring facing the grinding gap, since here no coverage by the grinding tools exists. As a result of this type of construction, the accessibility of the fastening means with the housing door open (FIG. 1) is optimized, so that the disassembly and assembly of the interchangeable ring is facilitated and therefore can be conducted more rapidly.

Advantageously, the fastening in this area likewise takes place by means of a form lock, which likewise accomplishes centering of the interchangeable ring and thus prevents imbalance. On the other hand, through the elements forming the form lock, advantageous dissipation of force from the grinding tools into the subconstruction is achieved.

Also, in an embodiment of the invention, the interchangeable ring with its outer circumference extends beyond the outer circumference of the supporting disk. As a result, the supporting disk can continue to have relatively small dimensions, which leads first of all to material savings and thus cost savings. In addition, with such a design, concentration of mass in the vicinity of the axis of rotation is achieved and thus the kinetic energy of the rotor during rotation of the device in accordance with the invention is kept small. Especially at high rotating speeds with large circumferential velocities, this situation gains importance.

In a further development of the concept of weight minimization and weight concentration in the area of the axis of rotation, in accordance with the invention it is suggested that the interchangeable ring be made of plastic, preferably of carbon fiber reinforced plastic, characterized by high strength with low weight.

In accordance with an embodiment of the invention, the grinding tools are bonded to the interchangeable ring. In this way full-surface fastening of the grinding tools in the adhesion joint is accomplished, so that the grinding tools can be made extremely thin-walled without breaking during installation.

In accordance with another embodiment of the invention it is provided that the adhesive bond be produced with a thermally deactivatable adhesive. In this way by simply heating the interchangeable ring or carrier ring, the grinding elements can be loosened from the supporting construction, so that these are again available for accommodating new, unused grinding tools.

Such thin grinding tools are especially suitable in an embodiment of the invention in which the interchangeable ring, on its inside facing the grinding gap, is essentially a flat design. In this way the processing step of machining off an annular recess during the manufacturing of the interchangeable ring is eliminated, with the advantage of cost-effective production.

Another embodiment of the invention provides for arranging the grinding tools on a supporting ring, and fastening the unit produced in this way, made of the grinding tools and supporting ring as a whole, on the interchangeable ring. In this manner, the need for having several spare interchangeable rings is eliminated without appreciably increasing the shutdown times. Instead it is sufficient to reserve the simpler-designed and less expensive supporting rings, which need only be placed in the interchangeable ring when needed.

In conjunction with adhesive-bonded grinding tools, this embodiment of the invention also offers the possibility for using the grinding tools and supporting ring as a disposable product without reducing the economy of the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
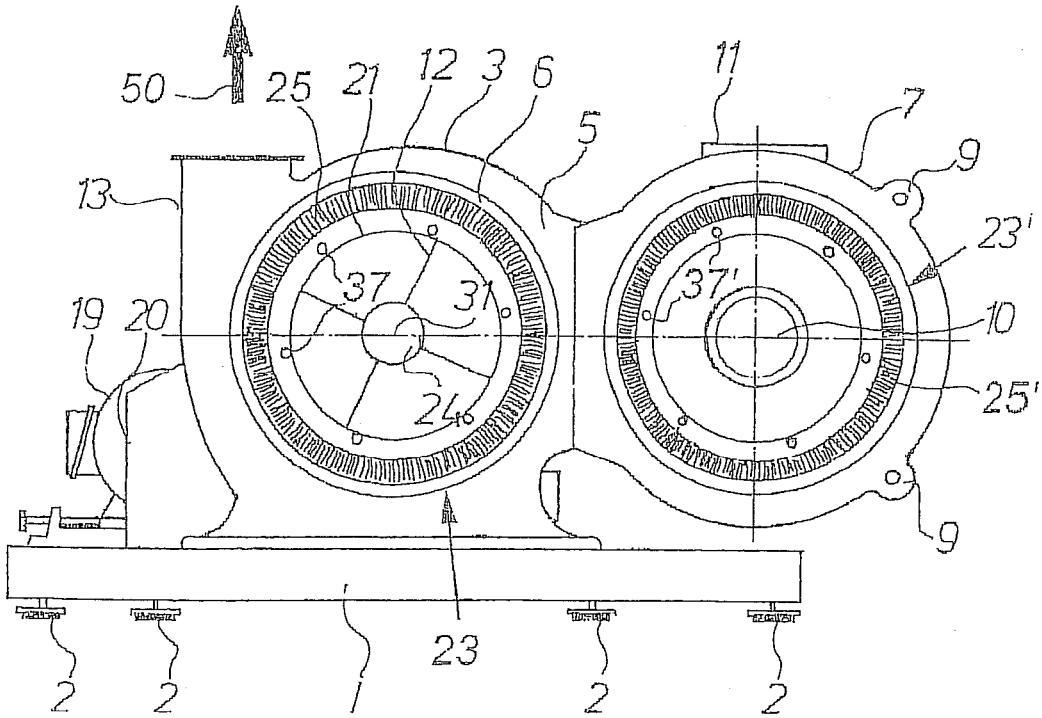
FIG. 1 illustrates a front view of a device in accordance with the invention with the housing door open.
Figure 2:
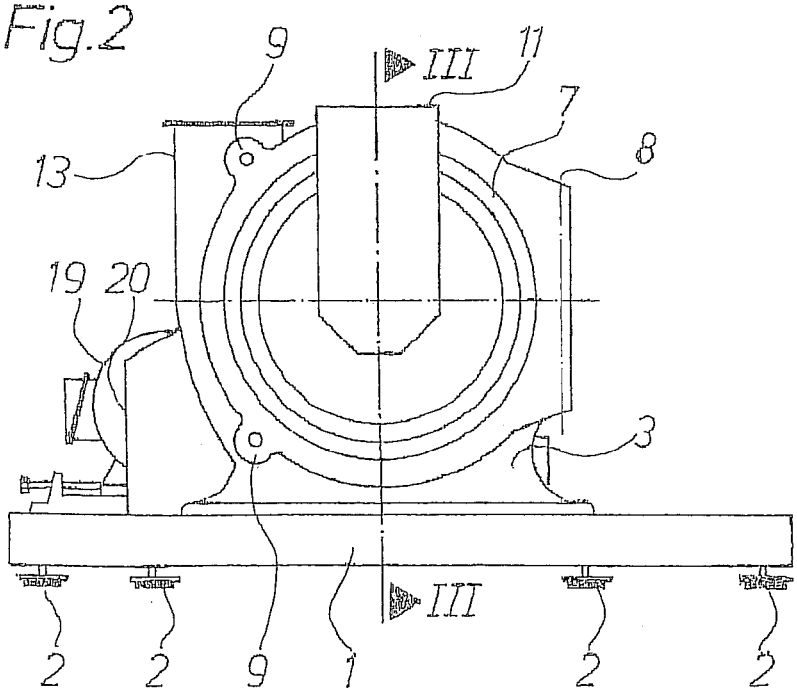
FIG. 2 illustrates a front view of the device shown in FIG. 1 with the housing door closed.
Figure 3:
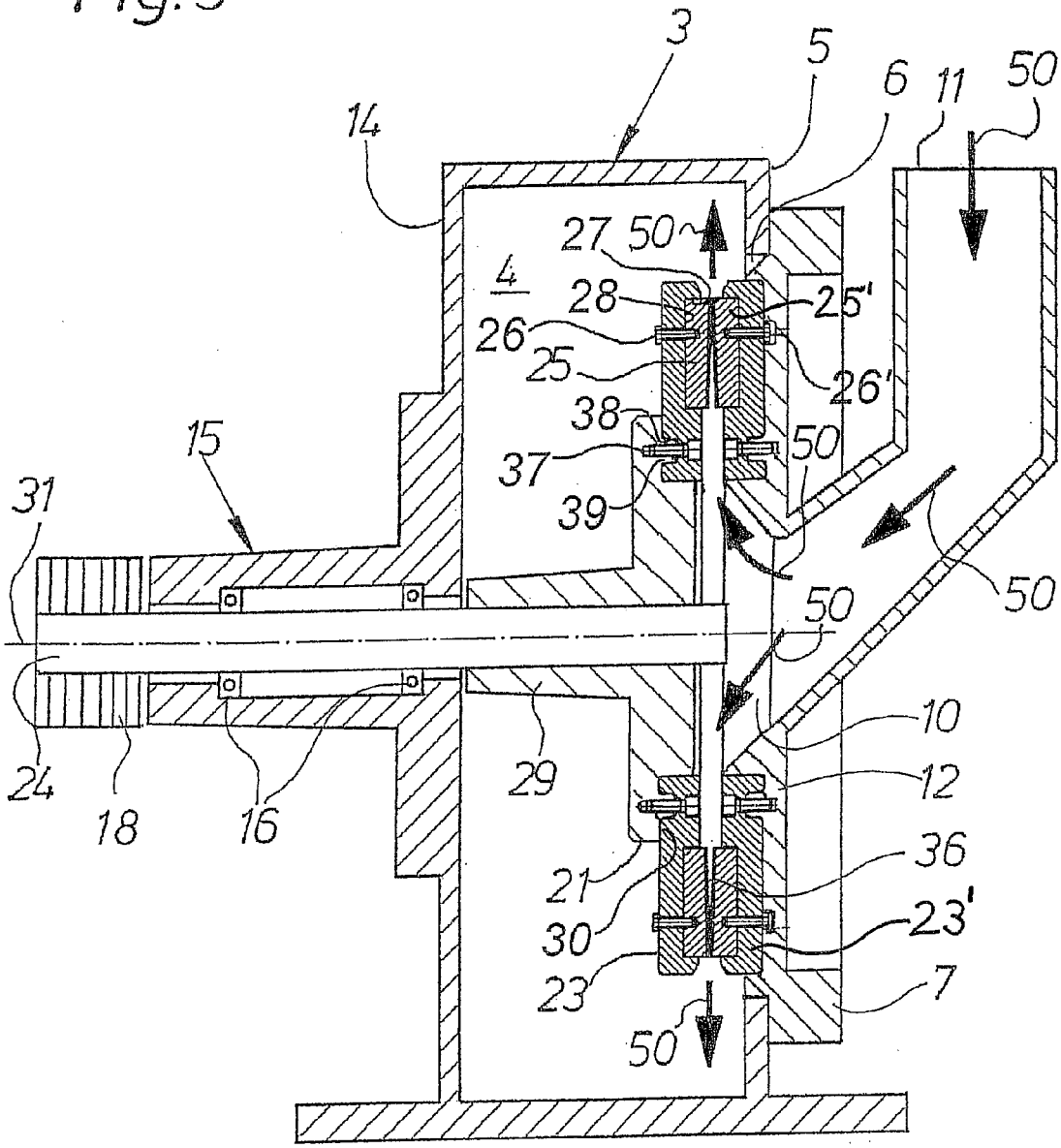
FIG. 3 illustrates a vertical section through the device shown in FIG. 2 along line III-III.

On the basis of FIGS. 1, 2, and 3, the fundamental structure of a device in accordance with the invention is described. In FIGS. 1 and 2, which show a front view with on one hand the housing door 7 open and on the other hand closed, one first sees a machine undercarriage 1, resting with its feet 2 on a solid base. The top of the machine undercarriage 1 forms a platform on which the grinding device in accordance with the invention is installed.

The grinding has an essentially drum-shaped housing 3, which surrounds a grinding chamber 4. The housing 3 on its front 5 has a central circular opening 6, which is closeable with the aid of a housing door 7 that can be pivoted around a vertical axis 8 and locked with locks 9.

The housing door 7 has a central filling opening 10, followed by, proceeding from the outside, a vertical dropping shaft 11, opening obliquely into the filling opening 10 in the foot area. Over the thickness of the housing door 7, the filling opening 10 expands conically to the grinding chamber 4. The material removal takes place over a material off-take 13, which in the visualization plane leads tangentially out of the housing 3 and which for example may be connected to a suction system.

The rear side 14 of the housing 3 is reinforced to form a horizontal support area 15 with the bearing groups 16. Through the backside 14 of the housing 3 extends a drive shaft 24 rotatably supported in the bearing groups 16, the outer end of which supports a multi-grooved disk 18. The multi-grooved disk 18 is connected over belts with the drive motor 19 shown only in FIGS. 1 and 2. The belts travel inside a protective lining 20.

At the opposite end of the drive shaft 24, located within the grinding chamber 4, with hubs 29, is supporting disk 21, which can be set into rotation around the axis of rotation 31 by means of its drive shaft 24. The disk 21 has radial distributor ribs 12 on its surface facing the opening 10.

The supporting disk 21 serves for fastening the interchangeable ring 23 within the grinding chamber 4 and for this purpose, on the side facing the grinding gap 36 has an indentation 30, on the radial delimiting surface of which an annular projection 39 coaxial to the axis of rotation 31 is placed.

The projection 39 interacts with a corresponding annular groove 38 on the inner circumferential area of the interchangeable ring 23, in order to transfer the forces that arise during the grinding operation through the form locking produced in this way. In addition, for fixing the interchangeable ring 23 in the indentation 30 of the supporting disk 21, six fastening screws 37 distributed uniformly over the circumference are provided, which, originating from the grinding gap plane, extend in the axial direction through the interchangeable ring 23 into the annular projection 39 (also see FIGS. 4 to 6).

In the outer circumferential area of the interchangeable ring 23, on the side facing the grinding gap is an annular disk-shaped recess 28, which likewise is coaxial to the axis of rotation 31. The recess 28 serves to accommodate the grinding tools 25 in the form of single segments (FIG. 7) or a whole ring (FIG. 8). By means of the screws 26, which extend from the reverse side of the interchangeable ring 23 beyond the base of the recess 28, the grinding tools 25 are retained in the recess 28. On the other hand, radial forces are led off by the form locking between the interchangeable ring 23 and the grinding tools 25; especially the outer contact surfaces of the recess 28 forming the ring shoulder 27 opposes the centrifugal forces operating during use.

An interchangeable ring 23' with grinding tools 25' formed as a mirror image to the grinding gap is fastened on the inside of the housing door 7 in a recess 35 forming a form lock with the backside of the interchangeable ring 23' by means of screws 47'. In this manner the grinding tools 25 and 25' are axially opposite one another while maintaining a radial grinding gap 36.

Figure 6:
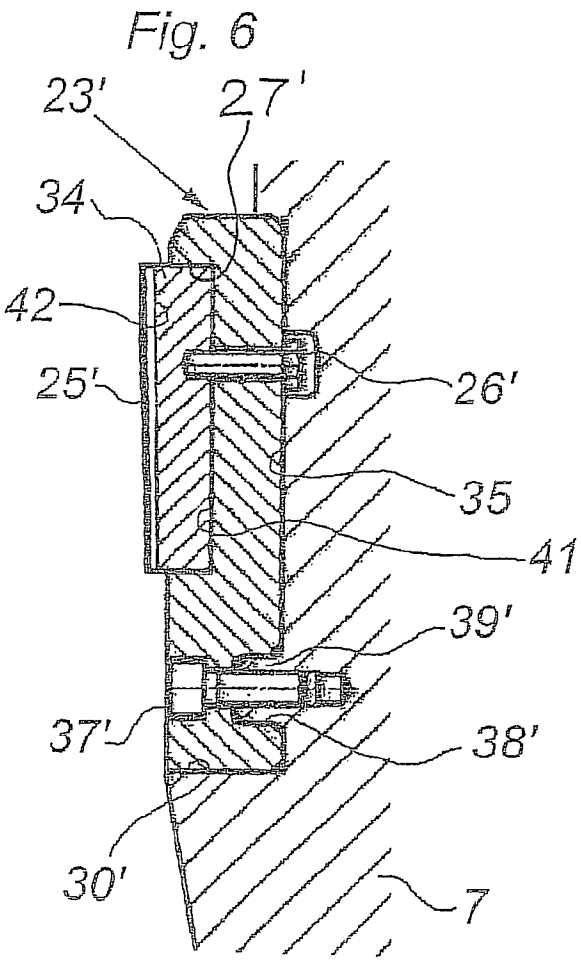
FIGS. 4, 5, and 6 illustrate partial sections of different embodiments of the invention in the area of the interchangeable ring.
Figure 5:
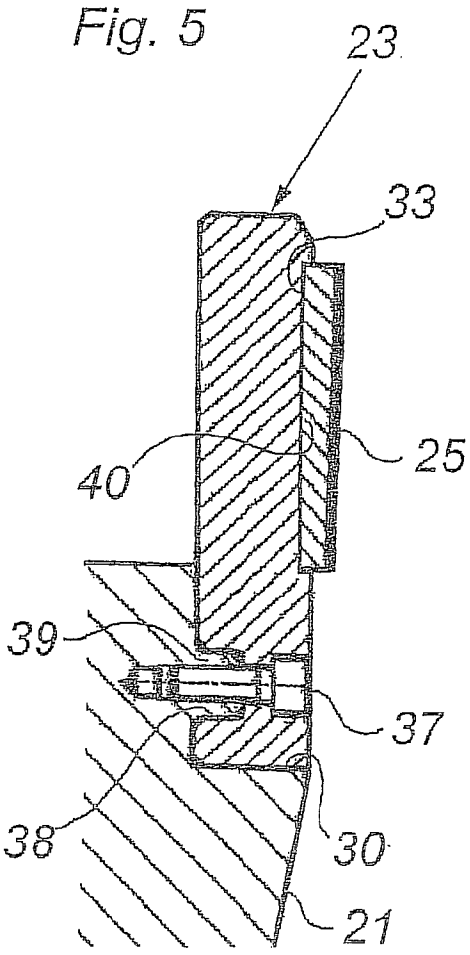
Figure 4:
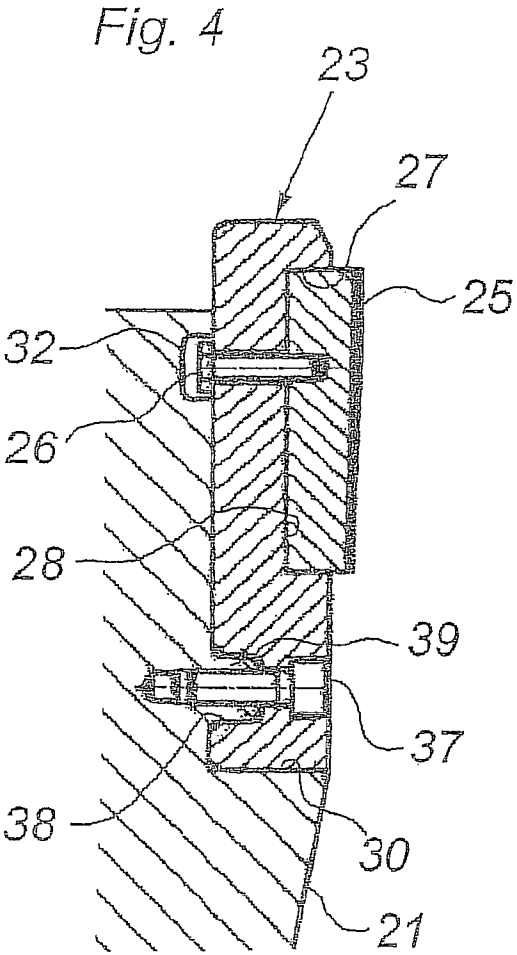

FIGS. 4, 5 and 6 show partial sections through various embodiments of the invention in the area of the interchangeable ring 23 or 23'. For simplicity's sake, insofar as possible the same reference symbols have been used in the various embodiments for the same or modified parts. FIGS. 4 and 5 pertain to interchangeable rings that are fastened to the supporting disk 21, while FIG. 6 shows an interchangeable ring 23' fastened to the housing door 7. Naturally, all of the embodiments of interchangeable rings 23, 23' shown can be combined with all grinding tools 25 or 25' and can serve for fastening to both the supporting disk 21 and the housing door 7.

FIG. 4 corresponds most closely to the representation in FIG. 3. In particular one can see the interchangeable ring 23 with grinding tools 25, which is anchored over the annular projection 39 to the supporting disk 21, the annular groove 38 in the interchangeable ring 23 and the screws 47 in the area of the indentation 30.

In contrast to FIG. 3, in the embodiment according to FIG. 4 the supporting disk 21 does not end in the inner circumferential area of the interchangeable ring 23, but also extends radially outward until coverage of the screws 26 has been accomplished. To receive the heads of the screws 26, an annular groove 32 has been milled into the supporting disk 21 in the area of the recess, and the heads of the screws 26 lie in this [groove] protected from dirt and mechanical damage.

The embodiment of the invention shown in FIG. 5 is especially suitable for grinding the input material with high rotation speed and thus high circumferential speeds of the grinding tools 25. Once again an interchangeable ring 23 is seen, which is fastened to the supporting disk 21 in the manner described in FIG. 3. The interchangeable ring 23 consists of a carbon fiber-reinforced plastic and therefore has an extremely low weight with high strength.

On the side facing the grinding gap 36, the interchangeable ring 23 has a flat indentation 40 concentrically surrounding the axis of rotation 31, into which the grinding tools 25 are placed in a form-locking manner. The fastening of the grinding tools 25 in the recess takes place over a large-area bonding joint 33 between the backside of the grinding tools 25 and the base of the recess 40 in the interchangeable ring 23. It would also be conceivable to bond the grinding tools 25 onto a flat surface of the interchangeable ring 23.

The large-area bonding leads to a fastening method with a uniform application of load over the entire surface of the grinding tools 25, thus avoiding stress peaks that would otherwise arise in the area of the screws in the case of point fastening. Consequently, the grinding tools 25 can be made substantially thinner and thus lighter.

In FIG. 6 an additional embodiment of the invention is shown with an arrangement of the interchangeable ring 23' on the housing door 7, but the fastening of this to a supporting disk 21 is likewise possible. The interchangeable ring 23' is fastened to the back side of the housing door 7 as described under FIG. 3, wherein once again form locking is produced between the annular projection 39' in the housing 7 and the annular groove 38' in the interchangeable ring 23'. The screws 37' then serve for fixing the interchangeable ring 23' in the position predetermined by the form locking.

In contrast to the previously described embodiments, in the variants shown in FIG. 6, the grinding tools 25' are not fastened directly to the interchangeable ring 23' but rather under intermediate connection of a supporting ring 34. In this process the supporting ring 34 comes to lie in an annular disk-shaped coaxial recess 41 in the interchangeable ring 23' on the side facing the grinding gap 36 and is held by screws 26' in the recess 41 emanating from the back side of the interchangeable ring 23'. The surface 42 of the supporting ring 34 facing the grinding gap 36 is adhered with a thin coating of grinding tools 25' of constant thickness.

Figure 7:
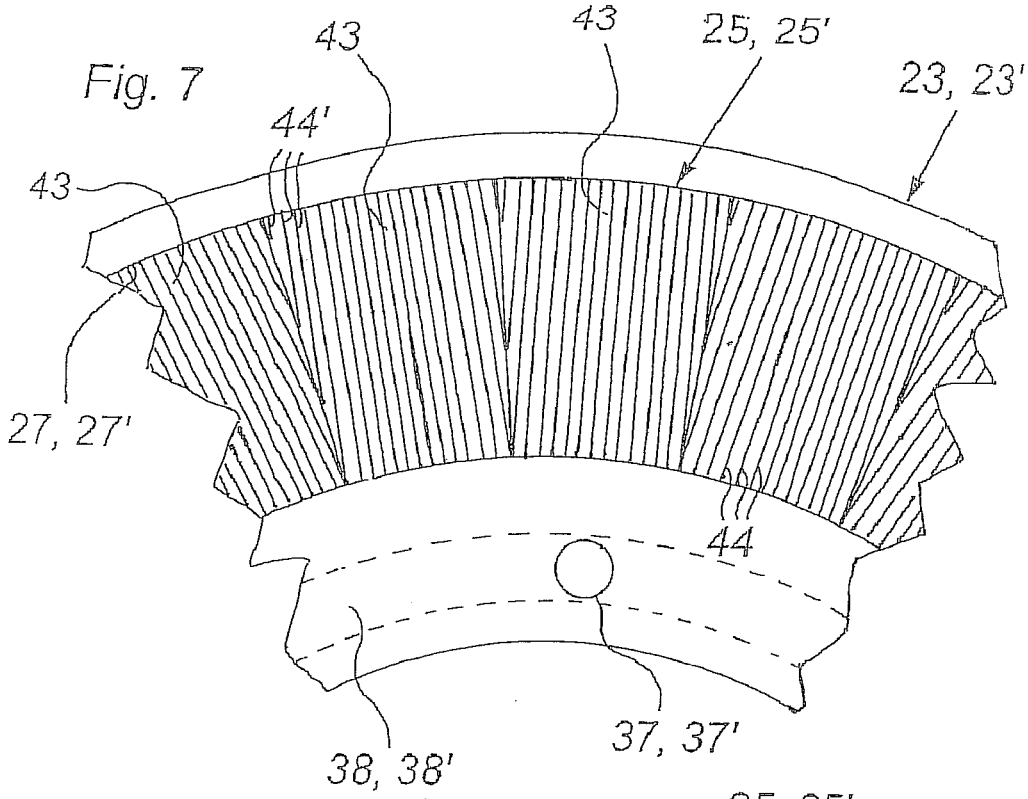
FIG. 7 illustrates a partial view of an interchangeable ring with segmented grinding tools.
Figure 8:
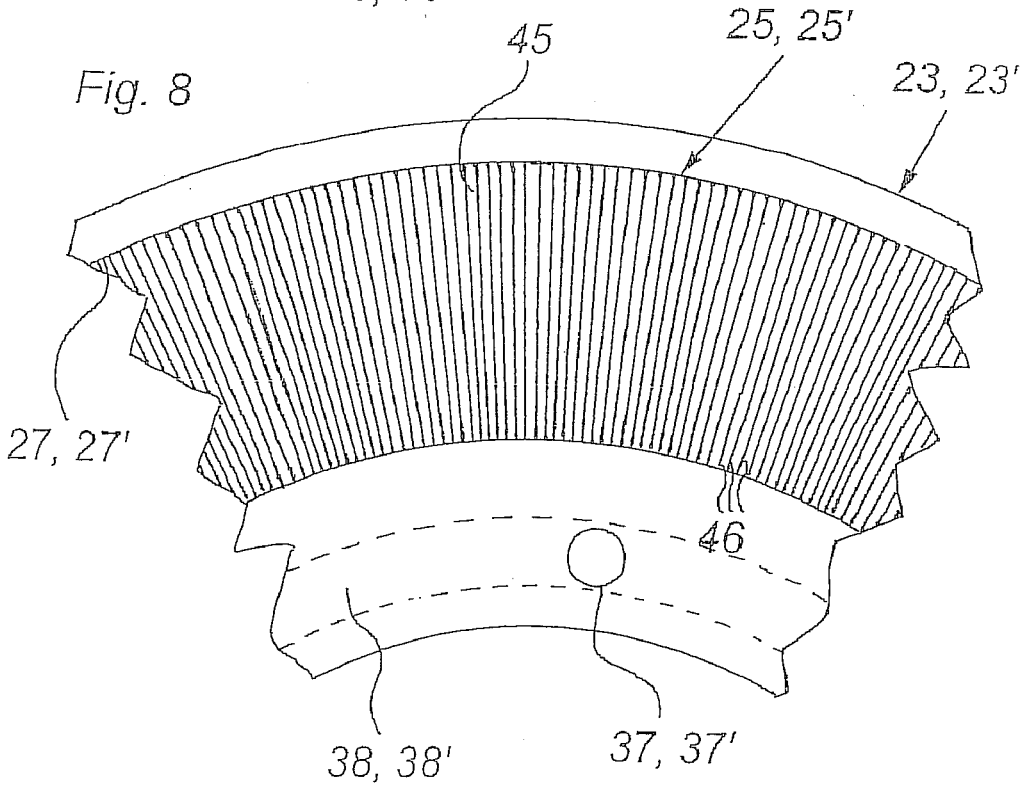
FIG. 8 illustrates a partial view of an interchangeable ring in accordance with the invention with an annular grinding element.

FIGS. 7 and 8 each show a circumferential section of an interchangeable ring 23 fitted with grinding tools 25. In FIG. 7 grinding tools 25 are seen in the form of trapezoidal segments 43, the effective surface of which is formed by corrugated strips 44, which travel parallel to one another within a single segment 43. As a result of the trapezoidal shape of the individual segments 43, shorter corrugated strips 44' form in the area of the radially traveling abutment joints, with grinding results characteristic for this type of corrugation.

In contrast to this, the grinding tools 25 according to FIG. 8 consist of a single-piece annular disk 45 extending over the entire circumference of the interchangeable ring 23, in which all corrugated strips 46 are aligned radially. In this way distances of the corrugated strips 45 from one another arise which increase from inside to outside, resulting in a different, likewise characteristic grinding result.

During operation of a grinding device in accordance with the invention, the input material is supplied to the dropping shaft 11, from where it enters centrally through the filling opening 10 into the grinding chamber 4 surrounded by the housing 3. There it first encounters the central area of the rotating supporting disk 21 and is there carried along by the distributor ribs 12 and subjected to circular movement. The centrifugal forces thus arising guide the input material in the radial direction to the grinding tools 25, 25'.

During passage through the grinding gap 36 formed by the grinding tools 25, 25', the input material is broken down on the corrugated strips 44 and 46. On leaving the grinding gap 36 in the radial direction, the work of grinding is ended and the input material is conveyed to additional processing stages over the tangential material outtake 13. The arrows 50 shown in FIG. 3 represent in idealized fashion the material flow through the device in accordance with the invention.

If a change in the grinding tools 25, 25' becomes necessary because of wear or changing to a different input material, the housing door 7 is opened with the supporting disk 21 standing still, so that the interchangeable rings 23, 23' become freely accessible from their side that is otherwise facing the grinding gap. By loosening the screws 47, 47' the interchangeable rings 23, 23' can be removed and replaced by an interchangeable ring equipped in advance with new grinding tools. After closing and locking the housing door 7, grinding operation can be resumed after brief shutdown.

Thus by keeping two additional grinding rings 23, 23' available it is possible to remove the used grinding tools 25, 25' from the previously removed interchangeable rings 23, 23' while operation continues. This is done either by loosening the screws 26, or in the case of adhesive bonding, by heating the adhesive in the adhesive joint 23 so that the adhesive loses its retaining force.

In the embodiment of the invention shown in FIG. 6 the interchangeable ring 23' is likewise removed from the grinding device after loosening the screws 47'. Outside of the grinding device, after loosening the fastening screws 26', the supporting ring 34 is removed and replaced by a previously prepared new supporting ring 34 with new grinding tools 25'. In this way a pair of interchangeable rings 23, 23' is suitable for operating a device in accordance with the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

The invention claimed is:

1. A device for grinding input material, the device comprising:

a first interchangeable ring;

a second interchangeable ring;

a supporting disk rotating around an axis of rotation inside a housing;

first grinding tools being arranged concentrically on a circumference of the supporting disk; and second grinding tools being provided axially opposite to the first grinding tools to thereby form a radial grinding gap, wherein the second grinding tools are arranged on the second interchangeable ring which is fastened in a fixed position on a door of the housing;

wherein the first grinding tools and the second grinding tools execute a relative movement with respect to one another, and wherein, for fastening the first grinding tools to the supporting disk, the first interchangeable ring is arranged and is removably fastened on the supporting disk concentrically to the axis of rotation and on which the first grinding tools are arranged, and wherein at least one of said first or second interchangeable rings is subdivided into an inner circumferential area and an outer circumferential area, wherein the inner circumferential area is provided for fastening the at least one of said first or second interchangeable rings to the supporting disk or the door of said housing, and the outer circumferential area is provided for fastening the grinding tools, and wherein the outer circumferential area of at least one of said first or second interchangeable rings has a concentric annular shoulder, which forms a radial stop for the grinding tools.

2. The device according to claim, 1, wherein the inner circumferential area of at least one of said first or second interchangeable rings has an annular groove, in which an annular projection on the supporting disk or the door of said housing meshes.

3. The device according to claim 1, wherein a fastener for at least one of said first or second interchangeable rings extends from a top of the interchangeable ring facing the grinding gap in the direction of the supporting disk or the door of said housing.

4. The device according to claim 1, wherein a fastener for the grinding tools extends from an outside of at least one of said first or second interchangeable rings into the grinding tools.

5. The device according to claim 1, wherein at least one of said first or second interchangeable rings includes a composite.

6. The device according to claim 5, wherein the composite material is a carbon fiber reinforced plastic.

7. The device according to claim 1, wherein an adhesive bond is provided between the grinding tools and at least one of said first or second interchangeable rings.

8. The device according to claim 1, wherein a side of at least one of said first or second interchangeable rings facing the grinding gap has a flat surface.

9. The device according to claim 1, further comprising a supporting ring onto which the grinding tools are fastened and which in turn is arranged concentrically on at least one of the first or second interchangeable rings.

10. The device according to claim 1, wherein the grinding tools are formed from a plurality of individual segments, each forming a circumferential section.

11. The device according to claim 1, wherein the grinding tools are each formed by an annular disk.

12. A device for grinding input material, the device comprising:

a first interchangeable ring;

a second interchangeable ring;

a supporting disk rotating around an axis of rotation inside a housing;

first grinding tools being arranged concentrically on a circumference of the supporting disk; and second grinding tools being provided axially opposite to the first grinding tools to thereby form a radial grinding gap, wherein the second grinding tools are arranged on the second interchangeable ring which is fastened in a fixed position on a door of the housing;

wherein the first grinding tools and the second grinding tools execute a relative movement with respect to one another, and wherein, for fastening the first grinding tools to the supporting disk, the first interchangeable ring is arranged and is removably fastened on the supporting disk concentrically to the axis of rotation and on which the first grinding tools are arranged, and wherein at least one of said first or second interchangeable rings is subdivided into an inner circumferential area and an outer circumferential area, wherein the inner circumferential area is provided for fastening the at least one of said first or second interchangeable rings to the supporting disk or the door of said housing, and the outer circumferential area is provided for fastening the grinding tools, and wherein the first interchangeable ring extends in a radial direction beyond an external circumference of the supporting disk.

13. The device according to claim 12, wherein the inner circumferential area of at least one of said first or second interchangeable rings has an annular groove, in which an annular projection on the supporting disk or the door of said housing meshes.

14. The device according to claim 12, wherein a fastener for at least one of said first or second interchangeable rings extends from a top of the interchangeable ring facing the grinding gap in the direction of the supporting disk or the door of said housing.

15. The device according to claim 12, wherein the outer circumferential area of at least one of said first or second interchangeable rings has a concentric annular shoulder, which forms a radial stop for the grinding tools.

16. The device according to claim 12, wherein a side of at least one of said first or second interchangeable rings facing the grinding gap has a flat surface.

17. The device according to claim 12, further comprising a supporting ring onto which the grinding tools are fastened and which in turn is arranged concentrically on at least one of the first or second interchangeable rings.

18. The device according to claim 12, wherein the grinding tools are formed from a plurality of individual segments, each forming a circumferential section.

19. The device according to claim 12, wherein the grinding tools are each formed by an annular disk.

20. The device according to claim 12, wherein the composite material is a carbon fiber reinforced plastic.

* * * * *